US007922306B2

(12) United States Patent
Hung

(10) Patent No.: US 7,922,306 B2
(45) Date of Patent: Apr. 12, 2011

(54) PRINT INK TRANSPORT MECHANISM FOR SELECTIVELY TRANSPORTING DIFFERENT COLORED INKS

(75) Inventor: Tsung-Chi Hung, Taipei County (TW)

(73) Assignee: Qisda Corporation, Taoyuan County (TW)

( * ) Notice: Subject to any disclaimer, the term of this patent is extended or adjusted under 35 U.S.C. 154(b) by 432 days.

(21) Appl. No.: 12/146,463

(22) Filed: Jun. 26, 2008

(65) Prior Publication Data

US 2009/0002464 A1 Jan. 1, 2009

(30) Foreign Application Priority Data

Jun. 26, 2007 (TW) ..... 96123062 A

(51) Int. Cl.
*B41J 2/17* (2006.01)
*B41J 2/175* (2006.01)

(52) U.S. Cl. ..... 347/84; 347/85

(58) Field of Classification Search ..... 347/84–85; 417/475, 477.9, 477.11; 137/595, 599.17, 137/601.18–601.19, 862, 867, 870; 251/4–10, 211

See application file for complete search history.

(56) References Cited

U.S. PATENT DOCUMENTS 2,291,267 A * 7/1942 Weiner ..... 366/177.1
6,033,060 A * 3/2000 Minami ..... 347/85

* cited by examiner

*Primary Examiner* — Stephen Meier
*Assistant Examiner* — Geoffrey Mruk

(57) ABSTRACT

A print ink transport mechanism includes a first ink pipe for transporting a first colored ink, and a second ink pipe for transporting a second colored ink, a rotary module including a first protruding component with a first cavity disposed in a position corresponding to the first ink pipe, and a drive means connected to the rotary module for driving the rotary module. When the drive means drives the rotary module to rotate to a first position, the first protruding component presses the second ink pipe, and the first ink pipe passes through the cavity on the first protruding component, so that the second ink pipe is unable to transport the second colored ink and the first ink pipe is able to transport the first colored ink.

26 Claims, 7 Drawing Sheets

PRINT INK TRANSPORT MECHANISM FOR SELECTIVELY TRANSPORTING DIFFERENT COLORED INKS

BACKGROUND OF THE INVENTION

1. Field of the Invention

The present invention relates to a print ink transport mechanism, and especially to a print ink transport mechanism capable of choosing different colored inks to print.

2. Description of the Prior Art

Inkjet print systems are widely used in many kinds of fax machines, printers, copy machines, and other types of office equipment. At present, the inkjet print system can be categorized into two kinds of design: one design utilizes a conjoined inkjet head and inkjet container, and another design utilizes a separate inkjet head and inkjet container. The separation type is superior for lowering the cost of printing. When the ink reservoir of the inkjet printing system in which the inkjet head and the inkjet container are separated experiences a shortage of some colored ink, the inkjet print system transports the needed colored ink from the ink tank to the ink reservoir. From the prior art, there are many ways to transport ink. For example, the invention taught by American Patent Publication No. 2005/0195240 utilizes a pin on a cap and a switching device in cooperation with a cam mechanism to meet the requirement of choosing different colors to supplement the inkjet container and transport each colored ink independently. However, this mechanism places a very strict tolerance on the switching device in order to prevent ink leakage, not to mention this mechanism has a lot of components, therefore its cost is very high.

In addition, an invention taught by American Patent Publication No. 2005/0212881 utilizes a design in which the content of the ink reservoir is greater than the content of the ink tank, and transports all colored inks from the ink tank into the ink reservoir at one time. If ink leakage happens because of a difference of pressure, a fluid ejector is utilized to eject ink, so that the problem of choosing one colored ink to supply disappears. But, because of this design, the total width of the print engine increases, and this mechanism makes the separation of the inkjet head and the inkjet container meaningless, because the weight and volume of the moving carrier increases, such that the motor driving the moving carrier consumes more power, and furthermore, because the carrier's moving distance increases, the total accuracy decreases. Therefore, a topic worth emphasizing is how to design a print ink transport mechanism capable of choosing different colored inks to print with separation of the inkjet head and the inkjet container.

SUMMARY OF THE INVENTION

The present invention offers a print ink transport mechanism capable of choosing different colored print inks to solve the above problem.

According to the present invention, a print ink transport mechanism capable of choosing different colored inks to print comprises an ink tank for storing a first colored ink and a second colored ink; an ink reservoir for receiving and storing the first colored ink and the second colored ink transported from the ink tank; a first ink pipe; a second ink pipe; a rotary module comprising a first protruding component and a first cavity formed in a position corresponding to the first ink pipe; and a drive means connected to the rotary module to drive the rotary module; wherein when the drive means rotates the rotary module to a first position, the first protruding component presses the second ink pipe, and the first ink pipe passes through the cavity on the first protruding component, so that the second ink pipe is unable to transport the second colored ink from the ink tank to the ink reservoir and the first ink pipe is able to transport the first colored ink from the ink tank to the ink reservoir.

The present invention further discloses that the drive means comprises a rotary axis connected to the rotary module; and a motor connected to the rotary axis for driving the rotary module to rotate through the rotary axis.

The present invention further discloses that the rotary module further comprises a second protruding component and a second cavity formed in a position corresponding to the second ink pipe, wherein when the drive means rotates the rotary module to a second position, the second protruding component presses the first ink pipe, and the second ink pipe passes through the cavity on the second protruding component, so that the first ink pipe is unable to transport the first colored ink from the ink tank to the ink reservoir and the second ink pipe is able to transport the second colored ink from the ink tank to the ink reservoir.

The present invention further discloses that the rotary module further comprises a third protruding component, when the drive means rotates the rotary module to a third position, the third protruding component is unable to press the first ink pipe and the second ink pipe, so that the first ink pipe and the second ink pipe is able to transport the first colored ink and the second colored ink from the ink tank to the ink reservoir respectively.

The present invention further discloses that the rotary module is disposed between the ink tank and the ink reservoir.

The present invention further discloses that the print ink transport mechanism further comprises an ink drive device for causing the first colored ink and the second colored ink to be transported from the ink tank through the first ink pipe and the second ink pipe respectively to the ink reservoir.

The present invention further discloses that the ink drive device is disposed between the ink tank and the rotary module.

The present invention further discloses that the ink drive device is disposed between the ink reservoir and the rotary module.

The present invention further discloses that the ink drive device is a pump.

The present invention further discloses that the print ink transport mechanism further comprises an ink drive device for evacuating air from the first ink pipe and the second ink pipe to transport the first colored ink and the second colored ink from the ink reservoir through the first ink pipe and the second ink pipe respectively to the ink tank.

The present invention further discloses that the rotary module is disposed between the ink reservoir and the ink drive device.

The present invention further discloses that the ink drive device is a pump.

According to a second embodiment of the present invention, a print ink transport mechanism capable of choosing different colored inks to print comprises an ink tank comprising a first partition and a second partition for storing a first colored ink and a second colored ink respectively; an ink reservoir comprising a first reservoir and a second reservoir for receiving and storing the first colored ink and the second colored ink transported from the ink tank respectively; a first ink pipe connecting the first partition in the ink tank and the first reservoir in the ink reservoir; a second ink pipe connecting the second partition in the ink tank and the second reservoir in the ink reservoir; a rotary module comprising a first protruding component and a first cavity formed in a position corresponding to the first ink pipe; a drive means connected to the rotary module for driving the rotary module; a control device coupled to the drive means for controlling the drive means to drive the rotary module to rotate, wherein when the drive means rotates the rotary module to a first position, the first protruding component presses the second ink pipe, and the first ink pipe passes through the cavity on the first protruding component, so that the second ink pipe is unable to transport the second colored ink from the ink tank to the ink reservoir and the first ink pipe is able to transport the first colored ink from the ink tank to the ink reservoir.

The present invention further discloses that the drive means comprises a rotary axis connected to the rotary module; and a motor connected to the rotary axis for driving the rotary module to rotate through the rotary axis.

The present invention further discloses that the rotary module further comprises a second protruding component and a second cavity formed in a position corresponding to the second ink pipe, wherein when the drive means rotates the rotary module to a second position, the second protruding component presses the first ink pipe, and the second ink pipe passes through the cavity on the second protruding component, so that the first ink pipe is unable to transport the first colored ink from the ink tank to the ink reservoir and the second ink pipe is able to transport the second colored ink from the ink tank to the ink reservoir.

The present invention further discloses that the rotary module further comprises a third protruding component, when the drive means rotates the rotary module to a third position, the third protruding component is unable to press the first ink pipe and the second ink pipe, so that the first ink pipe and the second ink pipe is able to transport the first colored ink and the second colored ink from the ink tank to the ink reservoir respectively.

The present invention further discloses that the rotary module is disposed between the ink tank and the ink reservoir.

The present invention further discloses that the inkjet print system further comprises an ink drive device for causing the first colored ink and the second colored ink to be transported from the ink tank through the first ink pipe and the second ink pipe respectively to the ink reservoir.

The present invention further discloses that the ink drive device is disposed between the ink tank and the rotary module.

The present invention further discloses that the ink drive device is disposed between the ink reservoir and the rotary module.

The present invention further discloses that the ink drive device is a pump.

The present invention further discloses that the inkjet print system further comprises an ink drive device for evacuating air from the first ink pipe and the second ink pipe to drive the first colored ink and the second colored ink from the ink reservoir through the first ink pipe and the second ink pipe respectively to the ink tank.

The present invention further discloses that the rotary module is disposed between the ink reservoir and the ink drive device.

The present invention further discloses that the ink drive device is a pump.

The present invention further discloses that the inkjet print system further comprises an ink detecting element coupled to the control device for detecting the status of the first colored ink stored in the ink reservoir, wherein the control device is for controlling the drive means to drive the rotary module to rotate to the first position according to the detected result of the ink detecting element.

The present invention further discloses that the inkjet print system is an inkjet printer.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
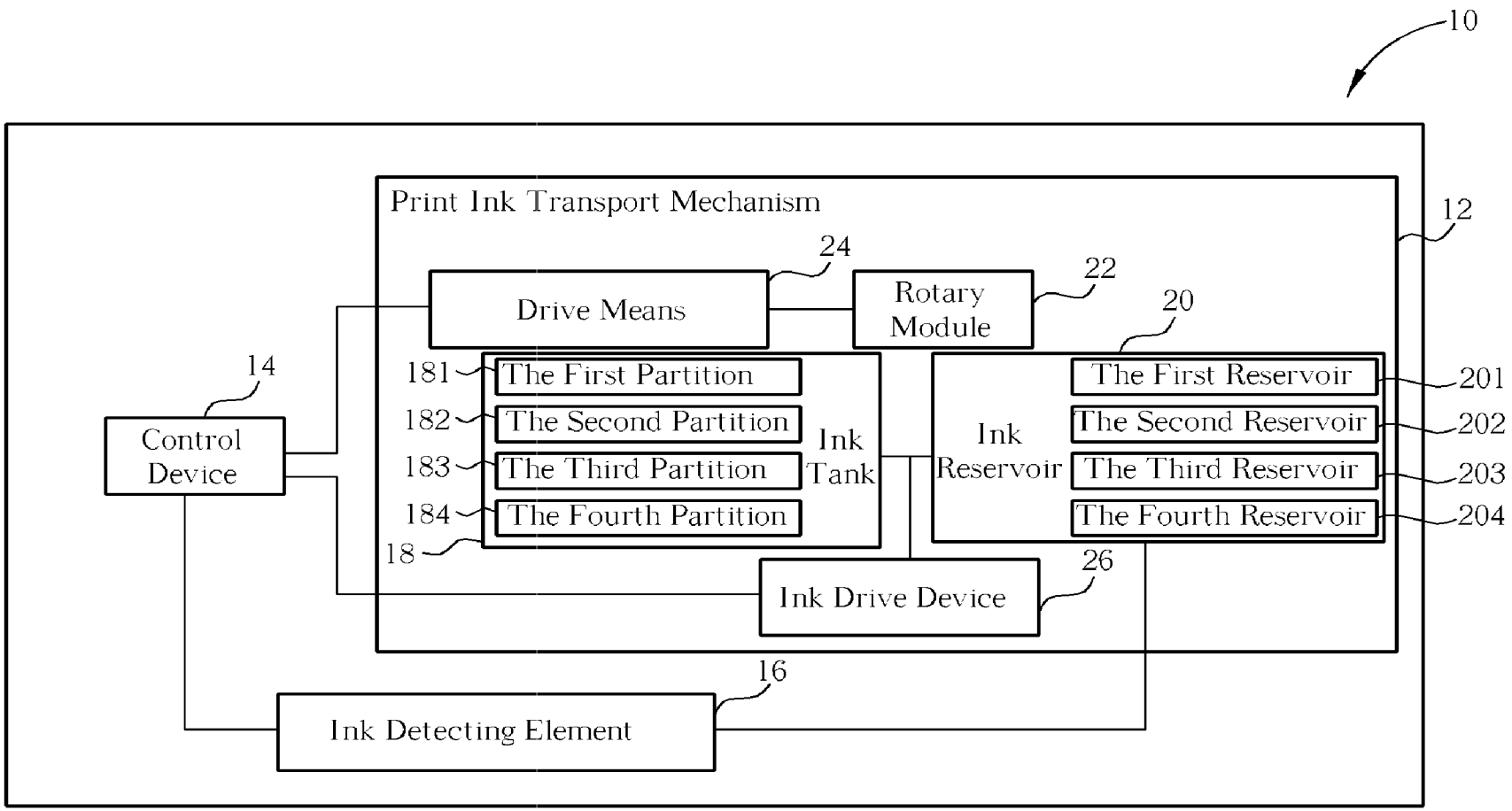
FIG. 1 is a functional block diagram of an inkjet print system according to the present invention.

Please refer to FIG. 1. FIG. 1 is a functional block diagram of an inkjet print system 10 according to the present invention. The inkjet print system 10 can be an inkjet printer, a fax machine, a copy machine, an all-in-one multifunction printer, etc. The inkjet print system 10 in a copy machine comprises a print ink transport mechanism 12, a control device 14, and an ink detection element 16. The print ink transport mechanism 12 comprises an ink tank 18 having a first partition 181, a second partition 182, a third partition 183, a fourth partition 184 for storing different colored inks respectively, an ink reservoir 20 having a first reservoir 201, a second reservoir 202, a third reservoir 203, a fourth reservoir 204 for receiving and storing the different colored inks transported from the first partition 181, the second partition 182, the third partition 183, the fourth partition 184 in the ink tank 18 respectively in order to supply the ink for the inkjet head, a rotary module 22, a drive means 24 connected to the rotary module 22 for driving the rotary module 22, and an ink drive device 26 for driving the different colored inks transported from the ink tank 18 through the corresponding ink pipes respectively to the ink reservoir 20. The ink drive device 26 can be a pump for evacuating ink from the ink tank 18 to the ink reservoir 20. The ink detection element 16 detects the status of each colored ink separately stored in the ink reservoir 20. The control device 14 is coupled to the ink detection element 16, the drive means 24, and the ink drive device 26 for controlling the action of the drive means 24 and the action of the ink drive device 26 according to the detected result of the ink detection element 16.

Please refer to FIG. 2 to FIG. 6. FIG. 2 to FIG. 6 are diagrams of the rotary module 22 at different positions after rotating according to the present invention. In the present embodiment, if the print ink transport mechanism 12 of the inkjet print system 10 can transport four different colored inks, e.g. ink of Yellow color, Magenta color, Cyan color, and Key color, then the print ink transport mechanism 12 further comprises a first ink pipe 28, a second ink pipe 30, a third ink pipe 32, and a fourth ink pipe 34. First ends of the first ink pipe 28, the second ink pipe 30, the third ink pipe 32, and the fourth ink pipe 34 are connected to the first partition 181, the second partition 182, the third partition 183, the fourth partition 184 in the ink tank 18 respectively, and other ends are connected to the first reservoir 201, the second reservoir 202, the third reservoir 203, the fourth reservoir 204 in the ink reservoir 20 respectively. The first ink pipe 28, the second ink pipe 30, the third ink pipe 32, and the fourth ink pipe 34 transport the yellow colored ink, the magenta colored ink, the cyan colored ink, and the key colored ink respectively from the first partition 181, the second partition 182, the third partition 183, the fourth partition 184 in the ink tank 18 to the first reservoir 201, the second reservoir 202, the third reservoir 203, the fourth reservoir 204 in the ink reservoir 20. The rotary module 22 can be disposed between the ink tank 18 and the ink reservoir 20 and above the first ink pipe 28, the second ink pipe 30, the third ink pipe 32, and the fourth ink pipe 34. The ink drive device 26 can be disposed between the ink tank 18 and the rotary module 22, or disposed between the ink reservoir 20 and the rotary module 22. In addition, the drive means 24 comprises a motor 36, and a rotary axis 38 connected between the motor 36 and the rotary module 22, the motor 36 can drive the rotary module 22 to the different positions shown in FIG. 2 to FIG. 6 through the rotary axis 38. Furthermore, the rotary module 22 comprises a first protruding component 40, a second protruding component 42, a third protruding component 44, a fourth protruding component 46, and a fifth protruding component 48. Angles between each protruding component are 72 degrees (360 degrees/5), or can be other degrees dependent on the designer. A first cavity 50 on the first protruding component 40 is disposed corresponding to the position of the first ink pipe 28; a second cavity 52 on the second protruding component 42 is disposed corresponding to the position of the second ink pipe 30; a third cavity 54 on the third protruding component 44 is disposed corresponding to the position of the third ink pipe 32; and a fourth cavity 56 on the fourth protruding component 46 is disposed corresponding to the position of the fourth ink pipe 34.

Figure 2:
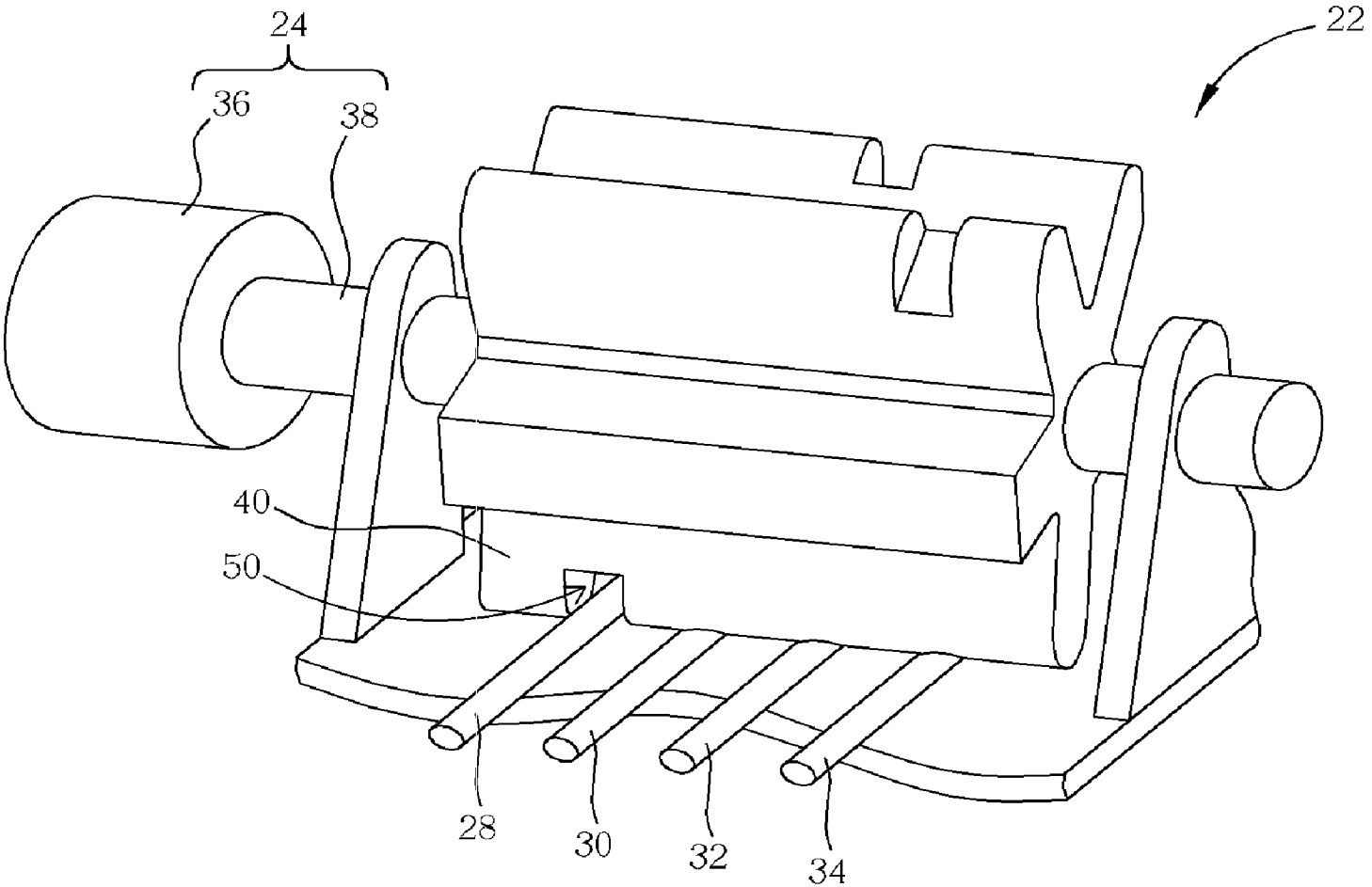
FIG. 2 to FIG. 6 are diagrams of a rotary module at different positions after rotating according to the present invention.

When the ink detection element 16 detects the ink reservoir 20 has a shortage of yellow colored ink, the ink detection element 16 will output a corresponding signal to the control device 14. At this time, the control device 14 will control the drive means 24 to drive the rotary module 22 to rotate to the position shown in FIG. 2, and control the ink drive device 26 to cause ink to be transported from the ink tank 18 to the ink reservoir 20. As shown in FIG. 2, when the drive means 24 drives the rotary module 22 to rotate to the position shown in FIG. 2, the first protruding component 40 presses the second ink pipe 30, the third ink pipe 32, and the fourth ink pipe 34, so that the second ink pipe 30, the third ink pipe 32, and the fourth ink pipe 34 is unable to transport the magenta colored ink, the cyan colored ink, and the key colored ink respectively. However, at this time the first cavity 50 on the first protruding component 40 contains the first ink pipe 28, which means that the first ink pipe 28 is not pressed. Therefore, the yellow colored ink can be transported from the ink tank 18 through the first ink pipe 28 to the ink reservoir 20, and the purpose of transporting the yellow colored ink solely can be accomplished.

Figure 3:
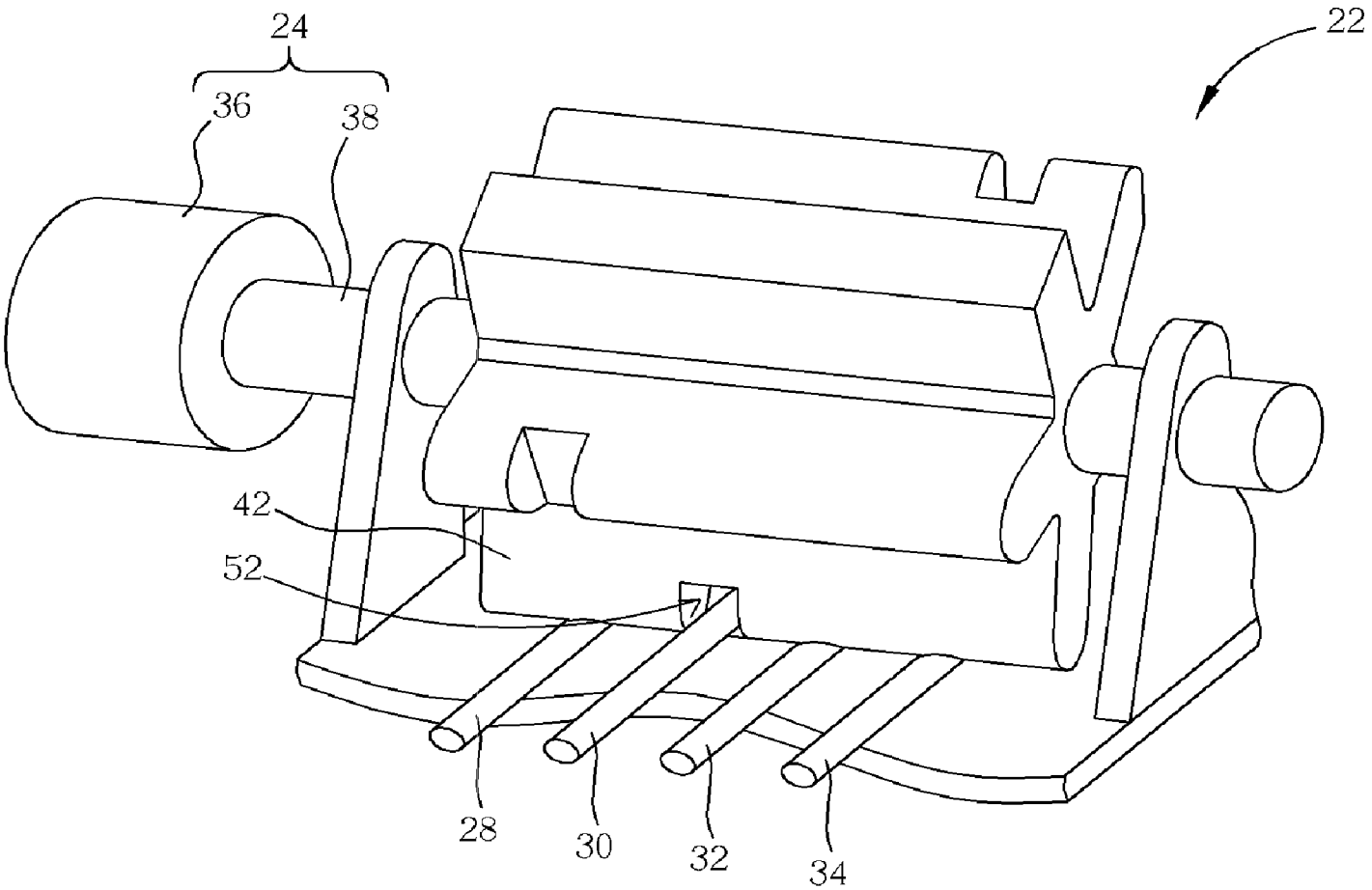

With the same method, when the ink detection element 16 detects the ink reservoir 20 has a shortage of magenta colored ink, the ink detection element 16 will output a corresponding signal to the control device 14. At this time the control device 14 controls the drive means 24 to drive the rotary module 22 to rotate to the position shown in FIG. 3, and control the ink drive device 26 to cause ink to be transported from the ink tank 18 to the ink reservoir 20. As shown in FIG. 3, when the drive means 24 drives the rotary module 22 to rotate to the position shown in FIG. 3, the second protruding component 42 presses the first ink pipe 28, the third ink pipe 32, and the fourth ink pipe 34, so that the first ink pipe 28, the third ink pipe 32, and the fourth ink pipe 34 is unable to transport yellow colored ink, cyan colored ink, and key colored ink respectively. However, at this time, the second cavity 52 on the second protruding component 42 contains the second ink pipe 30, which means that the second ink pipe 30 will not be pressed. Therefore, the magenta colored ink can be transported from the ink tank 18 through the second ink pipe 30 to the ink reservoir 20, and the purpose of transporting magenta colored ink solely can be accomplished.

Figure 4:
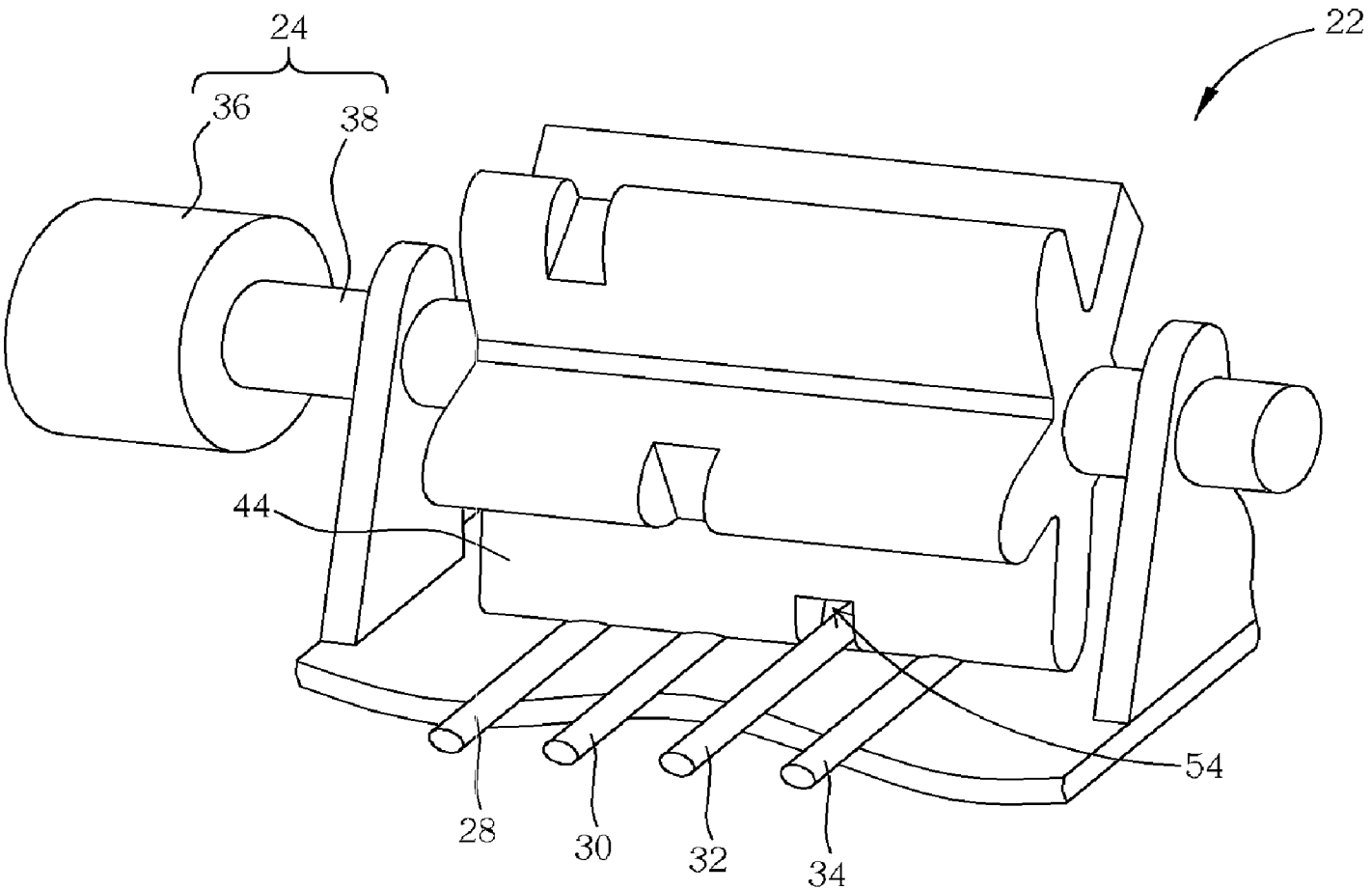

With the same method, when the ink detection element 16 detects the ink reservoir 20 shortage of cyan colored ink, the ink detection element 16 will output a corresponding signal to the control device 14. At this time, the control device 14 controls the drive means 24 to drive the rotary module 22 to rotate to the position shown in FIG. 4, and control the ink drive device 26 to cause ink to be transported from the ink tank 18 to the ink reservoir 20. As shown in FIG. 4, when the drive means 24 drives the rotary module 22 to rotate to the position shown in FIG. 4, the third protruding component 44 presses the first ink pipe 28, the second ink pipe 30, and the fourth ink pipe 34, so that the first ink pipe 28, the second ink pipe 30, and the fourth ink pipe 34 is unable to transport yellow colored ink, magenta colored ink, and key colored ink respectively. However, at this time, the third cavity 54 on the third protruding component 44 contains the third ink pipe 32, which means that the third ink pipe 32 will not be pressed. Therefore, the cyan colored ink can be transported from the ink tank 18 through the third ink pipe 32 to the ink reservoir 20, and the purpose of transporting cyan colored ink solely can be accomplished.

Figure 5:
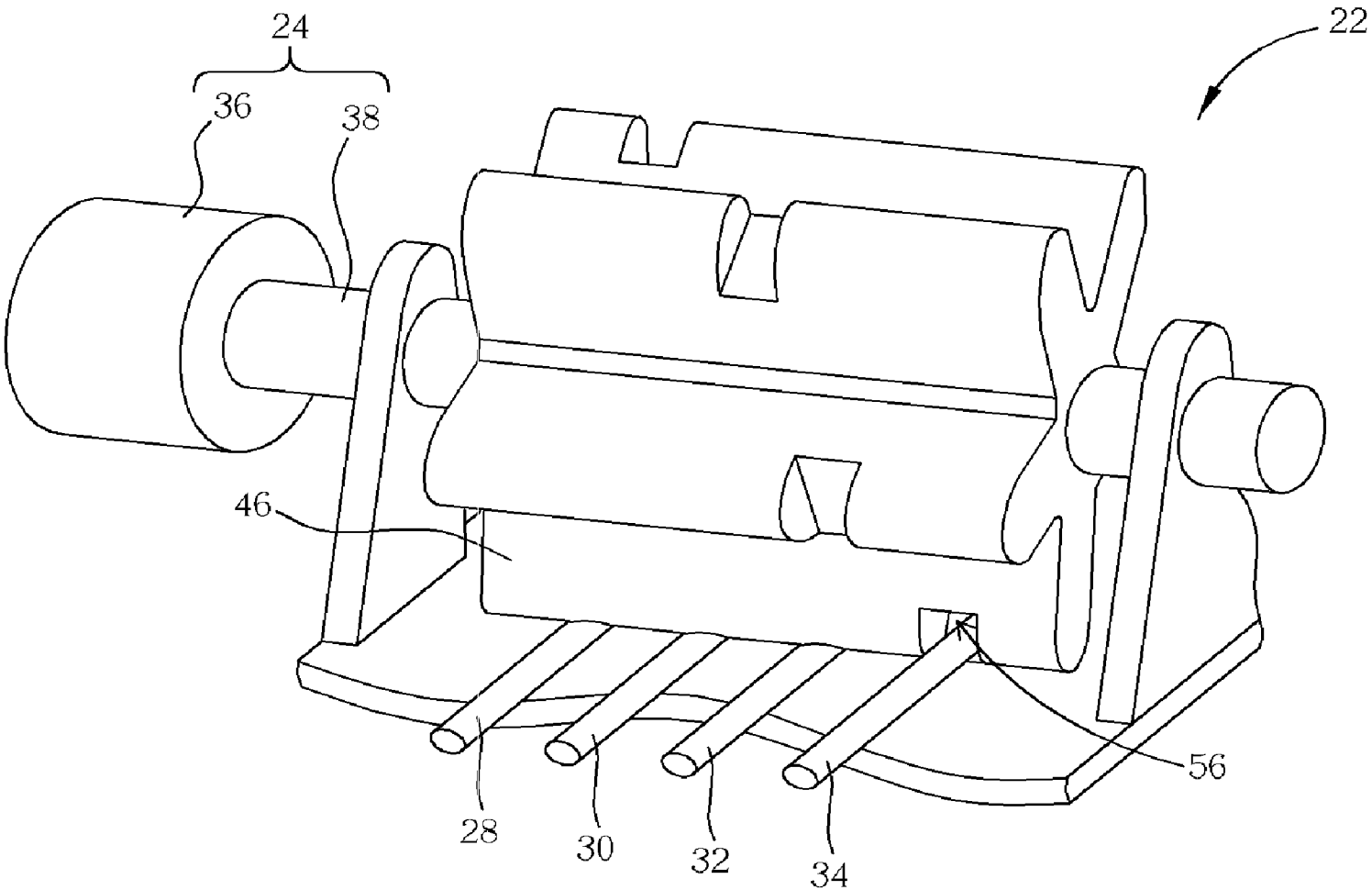

With the same method, when the ink detection element 16 detects the ink reservoir 20 has a shortage of key colored ink, the ink detection element 16 will output a corresponding signal to the control device 14. At this time, the control device 14 controls the drive means 24 to drive the rotary module 22 to rotate to the position shown in FIG. 5, and control the ink drive device 26 to cause ink to be transported from the ink tank 18 to the ink reservoir 20. As shown in FIG. 5, when the drive means 24 drives the rotary module 22 to rotate to the position shown in FIG. 5, the fourth protruding component 46 presses the first ink pipe 28, the second ink pipe 30, and the third ink pipe 32, so that the first ink pipe 28, the second ink pipe 30, and the third ink pipe 32 is unable to transport yellow colored ink, magenta colored ink, and cyan colored ink respectively. But, at this time, the fourth cavity 56 on the fourth protruding component 46 contains the fourth ink pipe 34, which means that the fourth ink pipe 34 will not be pressed. Therefore, the key colored ink is able to be transported from the ink tank 18 through the fourth ink pipe 34 to the ink reservoir 20, and the purpose of transporting key colored ink solely can be accomplished.

Figure 6:
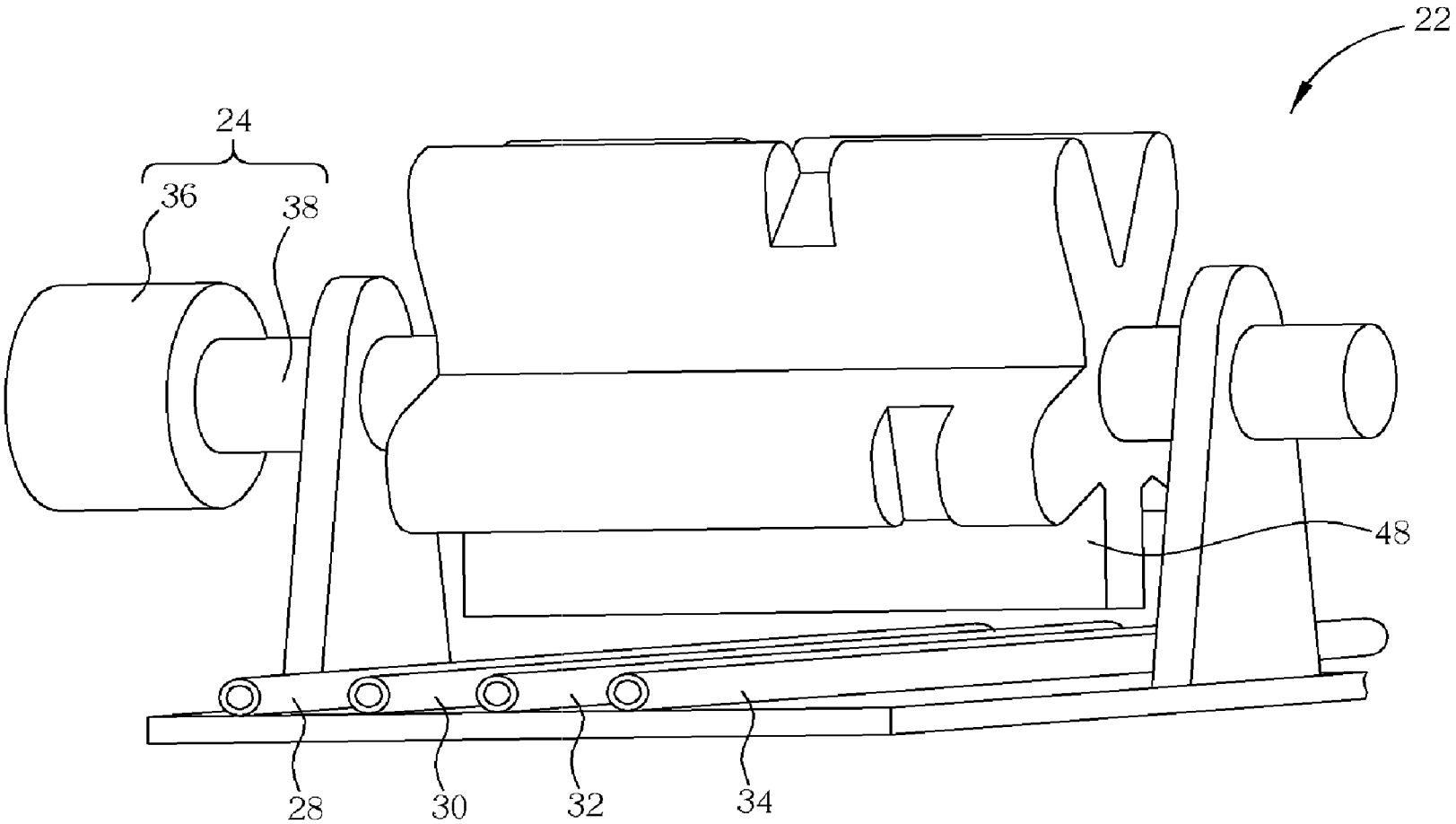

In addition, if transporting all four different colored inks from the ink tank 18 to the ink reservoir 20 at the same time is necessary, e.g. when the ink detection element 16 detects the ink reservoir 20 has shortages of all four different colored inks, the ink detection element 16 will output a corresponding signal to the control device 14. At this time, the control device 14 will control the drive means 24 to drive the rotary module 22 to rotate to the position shown in FIG. 6, and also control the ink drive device 26 to cause ink to be transported from the ink tank 18 to the ink reservoir 20. As shown in FIG. 6, when the drive means 24 drives the rotary module 22 to rotate to the position shown in FIG. 6, the fifth protruding component 48 is unable to press the first ink pipe 28, the second ink pipe 30, the third ink pipe 32, and the fourth ink pipe 34, so that the first ink pipe 28, the second ink pipe 30, the third ink pipe 32, and the fourth ink pipe 34 will transport yellow colored ink, magenta colored ink, cyan colored ink, and key colored ink from the ink tank 18 through the first ink pipe 28, the second ink pipe 30, the third ink pipe 32, and the fourth ink pipe 34 respectively to the ink reservoir 20, and the purpose of transporting ink of four different colors at the same time can be accomplished.

Figure 7:
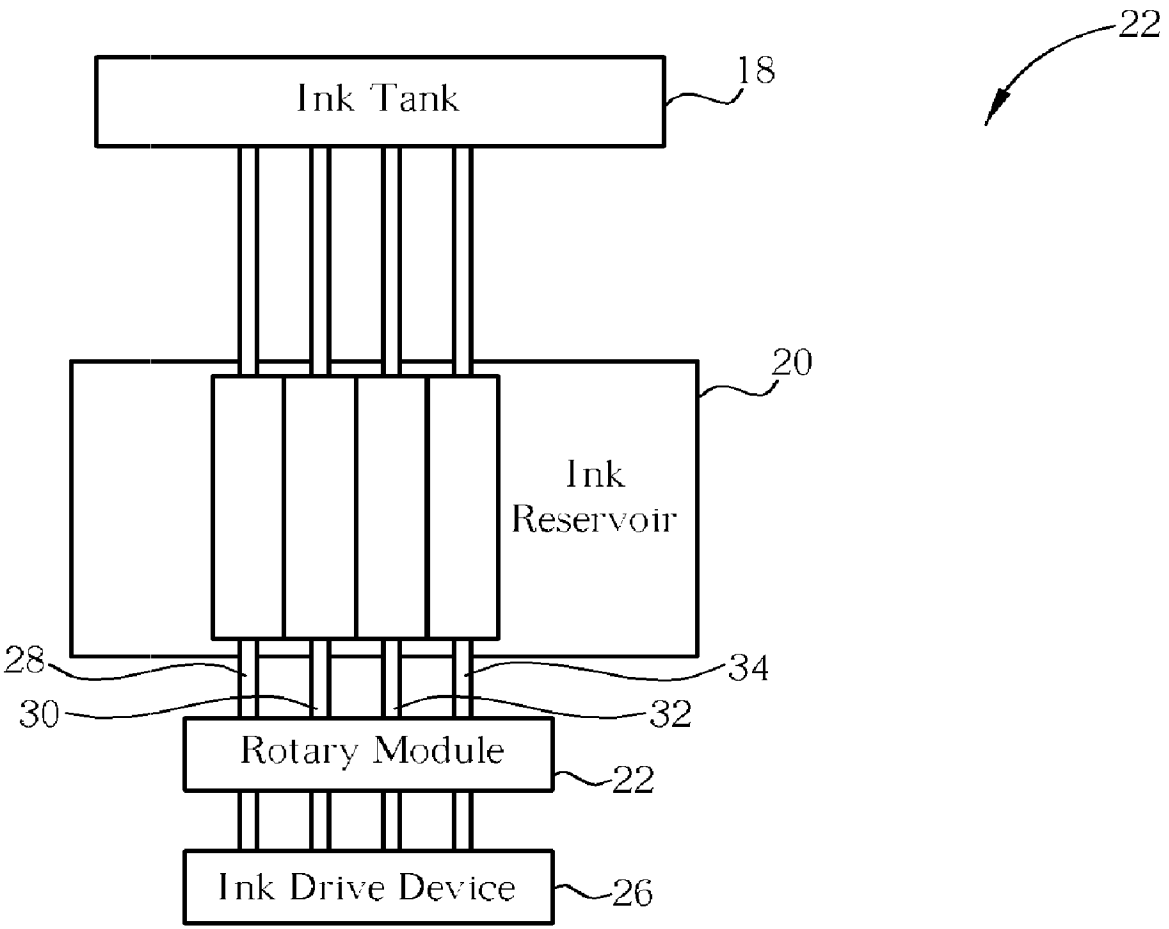
FIG. 7 is a relative positions diagram of the rotary module, an ink tank, an ink reservoir and a drive means of a second embodiment of the present invention.

The rotary module 22 does not have to be disposed between the ink tank 18 and the ink reservoir 20. Please refer to FIG. 7. FIG. 7 is a relative positions diagram of the rotary module 22, the ink tank 18, the ink reservoir 20 and the ink drive means 26 of a second embodiment according to the present invention. In this embodiment, there are four pipes between the ink tank 18 and the ink reservoir 20 for transporting yellow colored ink, magenta colored ink, cyan colored ink, and key colored ink respectively from the ink tank 18 to the ink reservoir 20. The first ink pipe 28, the second ink pipe 30, the third ink pipe 32, and the fourth ink pipe 34 are all for connecting the ink reservoir 20 and the ink drive device 26. The rotary module 22 is disposed between the ink reservoir 20 and the ink drive device 26 and above the first ink pipe 28, the second ink pipe 30, the third ink pipe 32, and the fourth ink pipe 34. The ink drive device 26 can be used for evacuating air in the first ink pipe 28, the second ink pipe 30, the third ink pipe 32, and the fourth ink pipe 34 respectively, in order to make a pressure difference between the ink tank 18 and the ink reservoir 20, and, through the pressure difference, yellow colored ink, magenta colored ink, cyan colored ink, and key colored ink is transported from the ink tank 18 respectively to the ink reservoir 20.

As with the above-mentioned embodiment, when the ink detection element 16 detects the ink reservoir 20 has a shortage of yellow colored ink, the ink detection element 16 will output a corresponding signal to the control device 14. At this time, the control device 14 will control the drive means 24 to drive the rotary module 22 to rotate to the position shown in FIG. 2, and control the ink drive device 26 to evacuate air in the first ink pipe 28, the second ink pipe 30, the third ink pipe 32, and the fourth ink pipe 34 respectively. The first protruding component 40 presses the second ink pipe 30, the third ink pipe 32, and the fourth ink pipe 34, so that the ink drive device 26 cannot efficiently evacuate the air in the second ink pipe 30, the third ink pipe 32, and the fourth ink pipe 34. But, the first cavity 50 on the first protruding component 40 contains the first ink pipe 28, which means that the first ink pipe 28 is not pressed. Therefore, the air can be evacuated from the first ink pipe 28 by the ink drive device 26, the yellow colored ink can be transported from the ink tank 18 to the ink reservoir 20, and the purpose of transporting yellow colored ink solely can be accomplished. The transport principle of other colored inks in this embodiment is the same as the afore-mentioned. Therefore, the description of the transport principle of other colored inks is omitted here.

In the above embodiment, the number of cavity on each protruding component of the rotary module 22 can be more than one. Therefore, more than one ink pipe can conduct at the same time. This means that, depending on the designer's needs, more than one colored ink can be transported at the same time. In addition, the print ink transport mechanism 12 of the inkjet print system 10 can transport more than four colored inks, which means any quantity of any number of colored inks, e.g. six colored inks or eight colored inks, can be transported at this time. The corresponding protruding component on the rotary module 22 should be designed to match the quantity of ink, and the operating principle is the same as in the above-mentioned embodiment, therefore the description is omitted here.

Compared with the conventional print ink transport mechanism, the print ink transport mechanism of the present invention utilizes a rotary module selectively to press the specific ink pipes in order to control the transport and supplement of the specific colored ink. Therefore, the purpose of transporting one colored ink or many colored inks at the same time can be accomplished.

Those skilled in the art will readily observe that numerous modifications and alterations of the device and method may be made while retaining the teachings of the invention.

What is claimed is:

1. A print ink transport mechanism for choosing different colored inks to print comprising:

an ink tank for storing a first colored ink and a second colored ink;

an ink reservoir for receiving and storing the first colored ink and the second colored ink transported from the ink tank;

a first ink pipe;

a second ink pipe;

a rotary module comprising a first protruding component with a first cavity formed in a position corresponding to the first ink pipe; and a drive means connected to the rotary module for driving the rotary module;

wherein when the drive means rotates the rotary module to a first position, the first protruding component presses the second ink pipe, and the first ink pipe passes through the cavity on the first protruding component, so that the second ink pipe is unable to transport the second colored ink and the first ink pipe is able to transport the first colored ink.

2. The print ink transport mechanism of claim 1 wherein the drive means comprises:

a rotary axis connected to the rotary module; and a motor connected to the rotary axis for driving the rotary module to rotate.

3. The print ink transport mechanism of claim 1, wherein the rotary module further comprises:

a second protruding component with a second cavity formed in a position corresponding to the second ink pipe;

wherein when the drive means rotates the rotary module to a second position, the second protruding component presses the first ink pipe, and the second ink pipe passes through the cavity on the second protruding component, so that the first ink pipe is unable to transport the first colored ink and the second ink pipe is able to transport the second colored ink.

4. The print ink transport mechanism of claim 1, wherein the rotary module further comprises: a third protruding component; wherein when the drive means rotates the rotary module to a third position, the third protruding component is able to press the first ink pipe and the second ink pipe, so that the first ink pipe is unable to transport the first colored ink from the ink tank to the ink reservoir and the second ink pipe is unable to transport the second colored ink from the ink tank to the ink reservoir.

5. The print ink transport mechanism of claim 1, wherein the rotary module is disposed between the ink tank and the ink reservoir.

6. The print ink transport mechanism of claim 1 further comprising:

an ink drive device for driving the first colored ink and the second colored ink transported from the ink tank through the first ink pipe and the second ink pipe respectively to the ink reservoir.

7. The print ink transport mechanism of claim 6, wherein the ink drive device is disposed between the ink tank and the rotary module.

8. The print ink transport mechanism of claim 6, wherein the ink drive device is disposed between the ink reservoir and the rotary module.

9. The print ink transport mechanism of claim 6, wherein the ink drive device is a pump.

10. The print ink transport mechanism of claim 1 further comprising an ink drive device for evacuating air in the first ink pipe and the second ink pipe in order to cause the first colored ink and the second colored ink to be transported from the ink tank through the first ink pipe and the second ink pipe respectively to the ink reservoir.

11. The print ink transport mechanism of claim 10 wherein the rotary module is disposed between the ink tank and the ink drive device.

12. The print ink transport mechanism of claim 10 wherein the ink drive device is a pump.

13. A print ink transport mechanism capable of choosing different colored inks to print comprising:

an ink tank comprising a first partition and a second partition for storing a first colored ink and a second colored ink respectively;

an ink reservoir comprising a first reservoir and a second reservoir for receiving and storing the first colored ink and the second colored ink transported from the ink tank respectively;

a first ink pipe connecting the first partition in the ink tank and the first reservoir in the ink reservoir;

a second ink pipe connecting the second partition in the ink tank and the second reservoir in the ink reservoir;

a rotary module comprising a first protruding component with a first cavity formed in a position corresponding to the first ink pipe; a drive means connected to the rotary module for driving the rotary module;

a control device coupled to the drive means for controlling the drive means to drive rotation of the rotary module;

wherein when the drive means rotates the rotary module to a first position, the first protruding component presses the second ink pipe, and the first ink pipe passes through the cavity on the first protruding component, so that the second ink pipe is unable to transport the second colored ink from the ink tank to the ink reservoir and the first ink pipe is able to transport the first colored ink from the ink tank to the ink reservoir.

14. The print ink transport mechanism of claim 13, wherein the drive means comprises:

a rotary axis connected to the rotary module; and a motor connected to the rotary axis for driving the rotary module to rotate.

15. The print ink transport mechanism of claim 13, wherein the rotary module further comprises a second protruding component, and a second cavity formed in a position corresponding to the second ink pipe, wherein when the drive means rotates the rotary module to a second position, the second protruding component presses the first ink pipe, and the second ink pipe passes through the cavity on the second protruding component, so that the first ink pipe is unable to transport the first colored ink from the ink tank to the ink reservoir and the second ink pipe is able to transport the second colored ink from the ink tank to the ink reservoir.

16. The print ink transport mechanism of claim 13, wherein the rotary module further comprises a third protruding component, wherein when the drive means rotates the rotary module to a third position, the third protruding component is able to press the first ink pipe and the second ink pipe, so that the first ink pipe is unable to transport the first colored ink from the ink tank to the ink reservoir, and the second ink pipe is unable to transport the second colored ink from the ink tank to the ink reservoir.

17. The print ink transport mechanism of claim 13, wherein the rotary module is disposed between the ink tank and the ink reservoir.

18. The print ink transport mechanism of claim 13 further comprising an ink drive device for causing the first colored ink and the second colored ink to be transported from the ink tank through the first ink pipe and the second ink pipe respectively to the ink reservoir.

19. The print ink transport mechanism of claim 18, wherein the ink drive device is disposed between the ink tank and the rotary module.

20. The print ink transport mechanism of claim 18, wherein the ink drive device is disposed between the ink reservoir and the rotary module.

21. The print ink transport mechanism of claim 18, wherein the ink drive device is a pump.

22. The print ink transport mechanism of claim 13 further comprising an ink drive device for evacuating air from the first ink pipe and the second ink pipe so as to transport the first colored ink and the second colored ink from the ink reservoir through the first ink pipe and the second ink pipe respectively to the ink tank.

23. The print ink transport mechanism of claim 22, wherein the rotary module is disposed between the ink tank and the ink drive device.

24. The print ink transport mechanism of claim 22, wherein the ink drive device is a pump.

25. The print ink transport mechanism of claim 13 further comprising an ink detecting element coupled to the control device for detecting the status of the first colored ink stored in the ink reservoir, wherein the control device is for controlling the drive means to drive the rotary module to rotate to the first position according to the detected result of the ink detecting element.

26. The print ink transport mechanism of claim 14, wherein the print ink transport mechanism is an inkjet printer.

* * * * *